US006073295A

United States Patent [19]

Durenberger et al.

[11] Patent Number: 6,073,295

[45] Date of Patent: Jun. 13, 2000

[54] SWEEPING MACHINE WITH MOVABLE RECIRCULATION FLAP

[75] Inventors: Donald F. Durenberger, Dayton; Michael T. Basham, Maple Grove; Joseph F. D'Costa, New Hope, all of Minn.

[73] Assignee: Tennant Company, Minneapolis, Minn.

[21] Appl. No.: 09/139,792

[22] Filed: Aug. 25, 1998

[51] Int. Cl.[7] ..... E01H 1/04

[52] U.S. Cl. ..... 15/83

[58] Field of Search ..... 15/83, 84, 85, 15/86, 79.1, 52.1, 340.3, 55, 79.2

[56] References Cited

U.S. PATENT DOCUMENTS

| | | | |
|---|---|---|---|
| 742,657 | 10/1903 | Hosfeld | 15/84 |
| 1,042,860 | 10/1912 | Whittome | 15/83 |
| 3,093,853 | 6/1963 | Tamny | 15/83 |
| 3,584,325 | 6/1971 | Larsen et al. | 15/83 |
| 3,930,277 | 1/1976 | Wulff | 15/83 |
| 5,276,933 | 1/1994 | Hennessey et al. | 15/83 |

FOREIGN PATENT DOCUMENTS

| | | | |
|---|---|---|---|
| 2960889 | 8/1989 | Australia . | |
| 391010 | 10/1990 | European Pat. Off. | 15/83 |
| 0843046 | 5/1998 | European Pat. Off. . | |
| 460069 | 9/1968 | Switzerland | 15/83 |

*Primary Examiner*—Gary K. Graham

*Attorney, Agent, or Firm*—McEachran, Jambor, Keating, Bock & Kurtz

[57] ABSTRACT

A sweeping machine has a chassis, wheels for supporting the chassis and a brush mounted on the chassis for rotation to throw debris over the brush and into a debris hopper mounted on the chassis behind the brush. There is a control lever on the chassis for raising and lowering the brush relative to a surface to be swept. As the brush wears, a recirculation flap is positioned between the brush and the debris hopper and located closely adjacent a rear portion of the brush to direct debris not reaching the debris hopper forwardly toward the brush sweeping zone. The recirculation flap is moved toward and away from the brush concurrently with movement of the brush toward the surface being swept as the brush wears, whereby the space between the rear portion of the brush and the recirculation flap remains relatively constant.

9 Claims, 6 Drawing Sheets

18

20
48
46
50
82
32
72
74
38
70
68
36
37
40
64
42
76
44
52
98
65
62
60
110
63
34
92
10
61
54
104
58
30
106

18
20
48
46
50
32
82
38
70
68
74
36
40
37
64
72
44
52
78
76
65
62
42
58
34
63
60
61
54
30
10

84
22
80
82
24
86
88
90
112
100
96
94
92
110
98
102
101
104
97
106
10
30
26

SWEEPING MACHINE WITH MOVABLE RECIRCULATION FLAP

THE FIELD OF THE INVENTION

The present invention relates to sweeping machines and more specifically to what are known in the art as over-the-top sweepers. In such machines, the main sweeping brush throws debris up and over the top of the brush into a debris hopper behind the brush, rather than throwing debris directly forward into a hopper in front of the brush in what is known as a forward throw sweeper. More particularly, the present invention relates to a movable recirculation flap which is positioned between the rear periphery of the brush and the debris hopper.

Conventional over-the-top sweepers have what is known as a recirculation flap which slopes down and forward at about a 45 degree angle and is located immediately behind the main brush and between the rear periphery of the brush and the debris hopper. All sweepers tend to throw some debris over the brush. This debris would drop to the floor behind the brush and be lost, except that the recirculation flap directs it forward into the sweeping zone of the brush, so it will be swept up a second time and loaded into the hopper. A forward throw sweeper throws only a small part of the total debris over the brush, but an over-the-top sweeper throws all of it over the brush, and a percentage of such debris will drop between the brush and the front wall of the hopper. Thus, an effective recirculation flap is very important in an over-the-top sweeper.

Normally, it is important to maintain a small clearance on the order of ¼" or so between the rear periphery of the brush and the recirculation flap. It is also important to maintain this clearance as the brush wears down to a smaller diameter. brush is considered to be worn down to an extent for replacement when its diameter is 8". As this wear occurs, the clearance between the brush and a fixed recirculation flap will inevitably increase, which will dramatically reduce the sweeping efficiency of the machine. The present invention solves this problem by having a movable recirculation flap, which recirculation flap is moved concurrently with adjustment of the position of the brush relative to a surface to be swept.

The main sweeping brush is mounted between a pair of brush arms which are pivotally mounted on the machine chassis. The brush arms are moved by a control lever accessible to the operator. Thus, the operator can control the position of the brush relative to the surface it is sweeping. Mounted on one of the brush arms is a lever which is in contact, through an intermediate lever, with an arm that extends out from the pivotal recirculation flap. The result of the interconnection described is that movement of the brush toward and away from a surface to be swept provides concurrent movement of the recirculation flap toward and away from the rear periphery of the sweeping brush, to the end that the gap between the brush and the recirculation flap remains essentially constant.

SUMMARY OF THE INVENTION

The present invention relates to sweeping machines of the type known as over-the-top sweepers and more particularly to a movable recirculation flap for such a machine.

A primary purpose of the invention is to provide a recirculation flap for use in the described environment which is moved concurrently with adjustment of brush position relative to the surface being swept.

Another purpose of the invention is to provide an over-the-top sweeper having a movable recirculation flap which moves concurrently with brush adjustment to maintain an essentially constant gap between the flap and the rear of the sweeping brush.

Another purpose is an over-the-top sweeper having a manual control to adjust brush position relative to the surface being swept, which manual control simultaneously moves a recirculation flap immediately behind the brush to maintain a constant flap/brush gap.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to sweeping machines and more specifically to what is known in the art as an over-the-top sweeper in that the debris is moved over the top of the brush as it transfers to the debris hopper which is located behind the brush.

Figure 1:
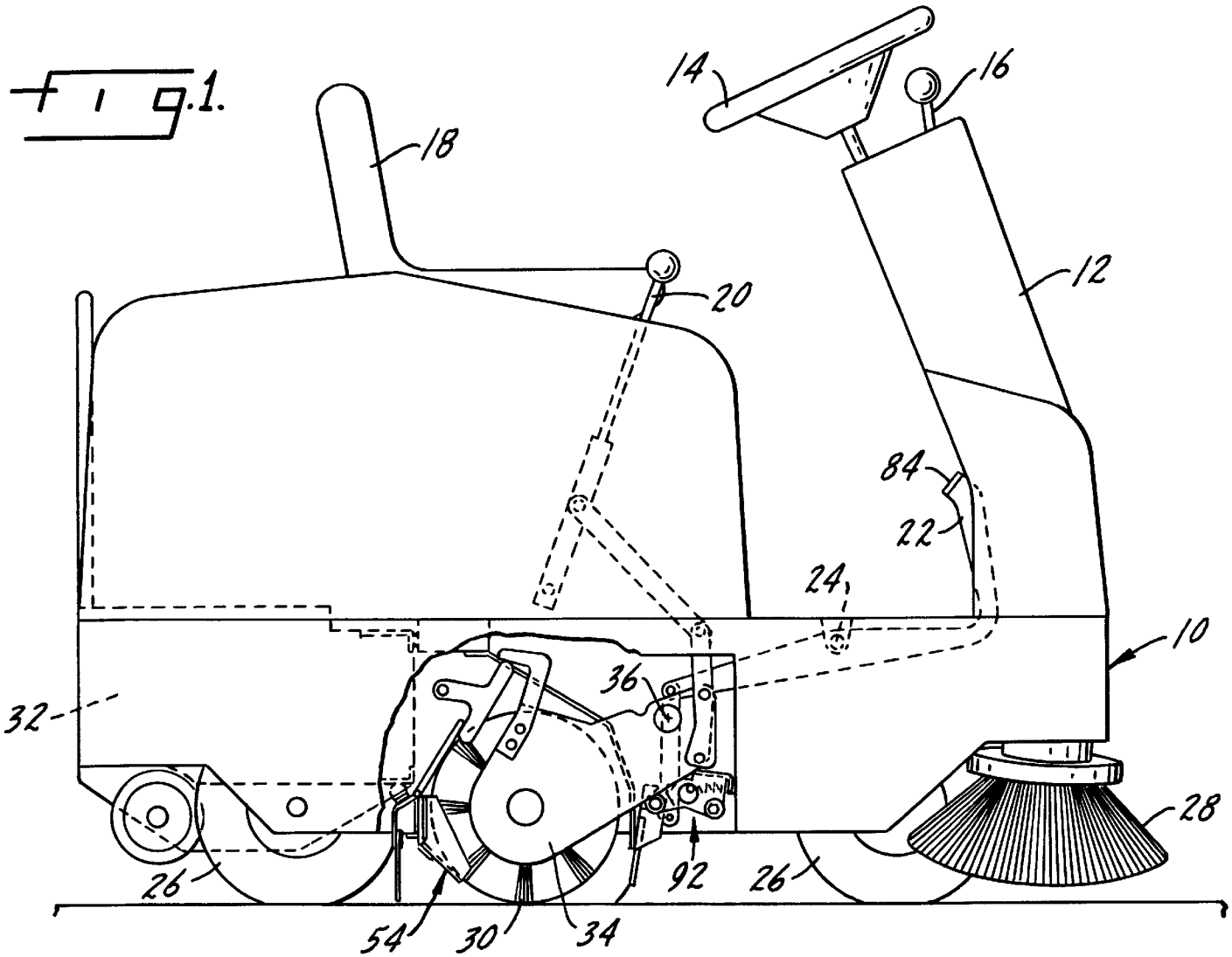
FIG. 1 is a side view, with portions broken away, of an over-the-top sweeping machine.

In FIG. 1, the sweeper includes a chassis 10 having a front control module 12 mounting a steering wheel 14 and a control lever 16. There is an operator seat 18 and a control lever 20 for use in changing the position of the sweeping brush relative to the surface being cleaned. A foot pedal 22 is pivotally mounted, as at 24, to the chassis 10, as will be described in more detail hereinafter. The chassis 10 is mounted on wheels 26 and may include front side brushes 28 and a main sweeping brush 30. Directly behind the brush 30 is a debris hopper 32. The brush 30 will have a conventional drive mechanism, not shown herein, but common on machines of this type.

Figure 2:
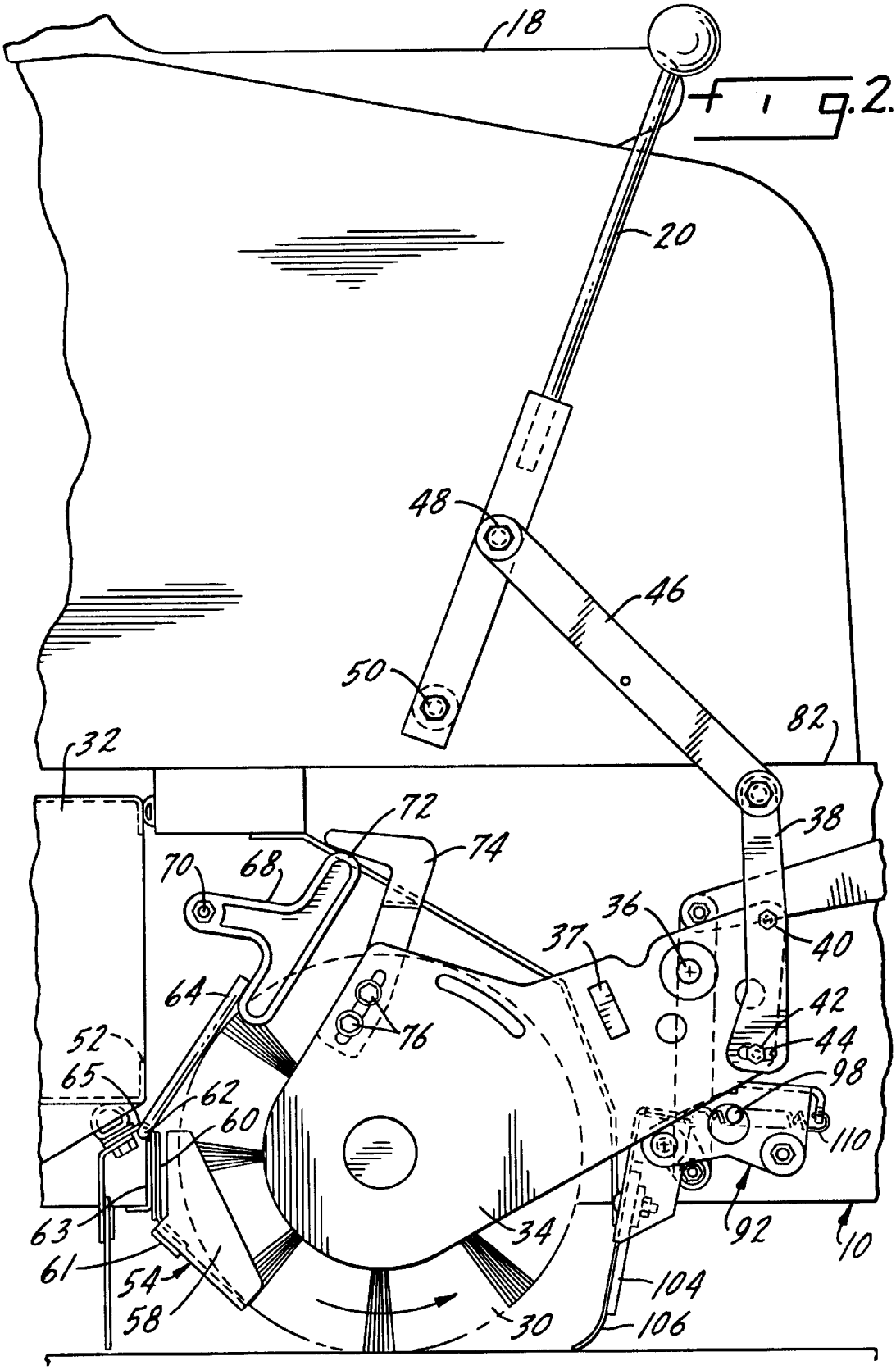
FIG. 2 is an enlarged partial side view illustrating the main sweeping brush and the mechanisms for moving the front flap and recirculation flap.

The main sweeping brush 30 is mounted for rotation between a pair of arms, one of which is indicated at 34. Each of the arms 34 will pivot about a pivotal mounting 36. The two arms are joined together in a torsionally rigid manner by a cross bar indicated at 37, and suitable fasteners, not shown. One arm 34 is attached to a link 38 by means of a fastener 40, midway of the link 38, and a fastener 42 at the lower end of the link 38, with the fastener 42 being located in an elongated slot 44. The upper end of link 38 is pivotally attached to an arm 46, which in turn is pivotally attached to the control lever 20. The lever 20 pivotally mounts the arm 46 intermediate its opposite ends, as at 48, and the lever 20 is pivotally attached to the chassis 10, as at 50. Thus, as shown in FIG. 2, pivotal movement of the lever 20 counterclockwise about its pivot point 50 has the effect of rotating the brush arms 34 about pivot point 36 in a counterclockwise direction. This movement is necessary to lower the brush as it becomes worn. Conventionally, sweeping brushes may wear from an 11" new diameter to an 8" worn diameter before the brush is discarded. In order to maintain the brush at the proper orientation relative to the surface to be cleaned, it is periodically lowered by the operator through manipulation of the lever 20. The above-described mechanism controls movement of the brush so that it is maintained in the proper location for sweeping.

Over-the-top sweepers throw all of the debris moved by the brush over the top of the brush and a percentage of such debris will drop between the brush and the front wall of the hopper. This dictates that a recirculation lip or flap be located directly behind the brush and that there be minimal clearance between the brush and the recirculation flap. Such clearance is preferably on the order of ¼" and must be maintained even when the brush is worn to a smaller diameter. The entrance into the debris hopper 32 is indicated at 52 and it is directly behind the brush 30. The recirculation flap is indicated generally at 54 and is located below and to the rear of the brush 30.

The flap 54 is made of a rubber or rubber-like material and has two side walls, one of which is indicated at 58. Flap 54 is attached to a support plate 60 by bolts and a retainer strip 61. Plate 60 is bolted to a second support plate 63, which has a round rod 62 welded along its upper edge. A "living hinge" 65, made of flexible rubber or rubber-like material, extends along support plate 63 and contributes to sealing the area against dust leakage. Rod 62 is journaled in portions of chassis 10, and the recirculation flap assembly as described here can pivot about it. Rod 62 includes a bent end 64 which extends upwardly and forwardly and is in contact with a T-shaped lever 68. The lever 68 is pivoted, as at 70, to a portion of the chassis 10 and has an upper end 72 in contact with an arm 74 which is bolted, as at 76, to the brush support arm 34.

Figure 3:
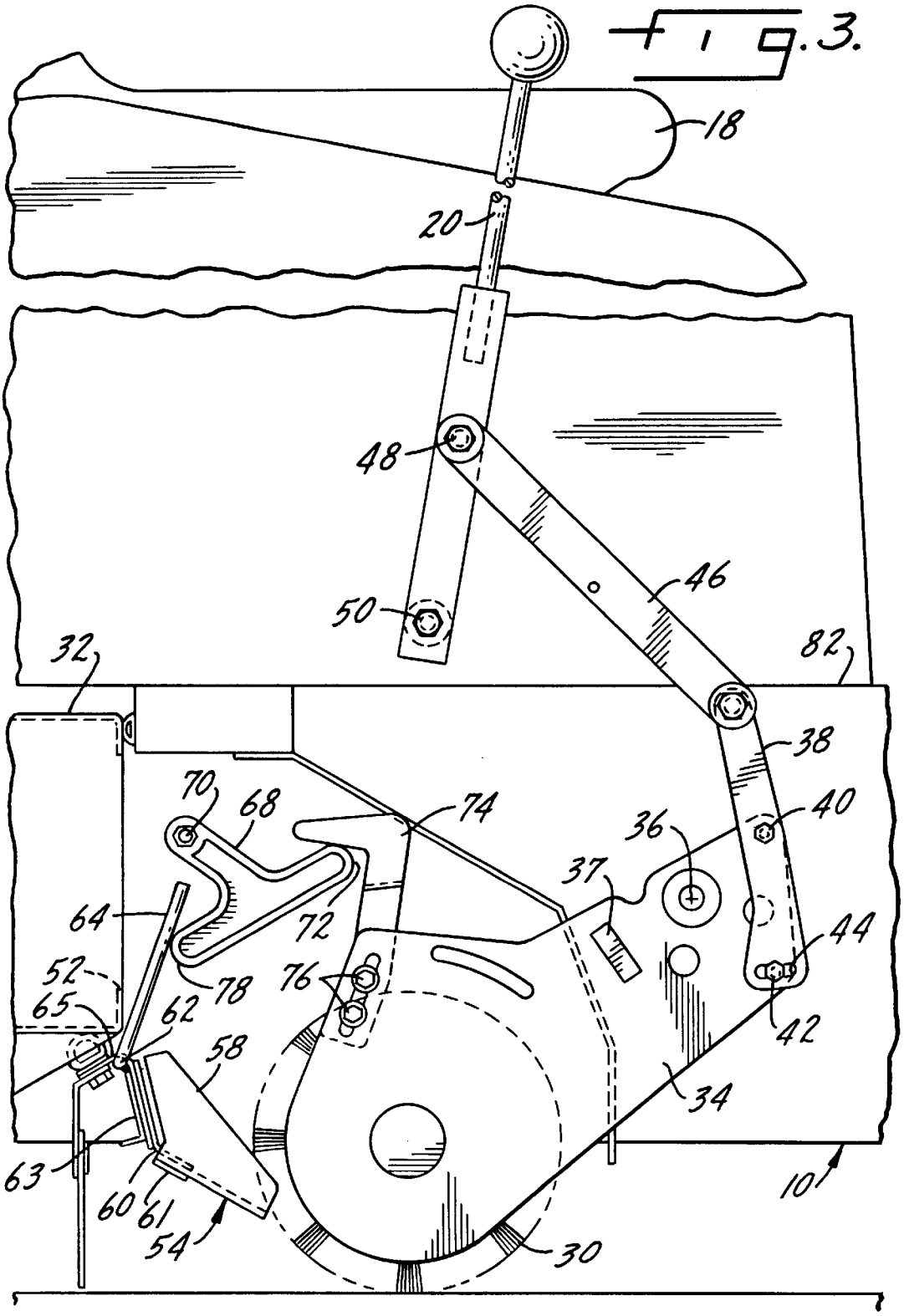
FIG. 3 is an enlarged partial side view, similar to FIG. 2, showing the recirculation flap in a second position.

FIG. 2 illustrates the relationship of the recirculation flap 54 and the brush 30 in a position in which the brush is new and it is at its full unused diameter. As the brush is worn, it will be periodically rotated about pivot point 36 so that it maintains a proper relationship to the surface being swept. FIG. 3 illustrates the brush in such a moved position. As the brush is pivoted about point 36 by movement of control lever 20, the arm 74, which is attached to the brush support arm 34, will also rotate in a counterclockwise direction. Movement of arm 74 will cause lever 68 to rotate in a clockwise direction, with the difference in position of this lever being shown by a comparison of FIGS. 2 and 3. As lever 68 moves in a clockwise direction, a lower portion thereof, indicated at 78, will cause counterclockwise movement of the arm 64 of rod 62. This in turn will pivot the recirculation flap in a counterclockwise direction so that it will maintain its proper orientation relative to the outer circumference of the brush 30. The difference in flap positions between FIGS. 2 and 3, and the difference in brush positions in the same two figures, illustrates the related movement of the brush and the recirculation flap brought about by the combination of arm 74 attached to the brush support arm 34, the pivotal lever 68, and the rod 64 which is attached to the recirculation flap 54.

It is inherent in over-the-top sweepers that the front wall of the brush housing and the sweeping lip must conform quite closely to the brush to enable the brush to efficiently raise debris. The sweeping lip must be flexible to admit debris under it, and it must drag on the floor to prevent the brush from throwing debris forward. However, because it must remain close to the brush, the lip cannot be lifted very high, or large debris passing under it and lifting it up would lift the lip into the brush, which would then whip it up and hold it off the floor. This would block the passageway for debris up and over the brush and create an opening at floor level through which all debris would be thrown forward.

The present invention provides an operator usable foot pedal which lifts the front flap or sweeping lip to two distinct raised positions, a first position in which the front flap is raised approximately 1" above the surface being swept, with further depression of the pedal swinging the flap assembly forward and up to provide a larger opening.

The foot pedal 22 includes a bushing 24 by which it is pivotally mounted between brackets 80 on the underside of floor 82 of the chassis 10. One end of the foot pedal 22 has a foot portion 84 which is accessible to the operator, as is clearly shown in FIG. 1. The opposite or rear end of pedal 22 is pivotally mounted to a link 86. The lower end of link 86 is pivotally mounted to an arm 88 of a front flap bracket 90 which forms a part of a flap assembly indicated generally at 92 and shown in exploded perspective form in FIG. 4.

The front flap assembly 92 includes a front skirt bracket 94 having arms 96 at the ends thereof. The arms 96 are each pivotally attached, as at 97, to downwardly extending brackets 99 which extend from the underneath side of the floor 82 of the chassis 10. Each of the brackets 99 carries a pin 98 which will ride within a hole 100 in the arms 96, with the pins providing a stop to limit movement of the flap assembly 92.

Figure 4:
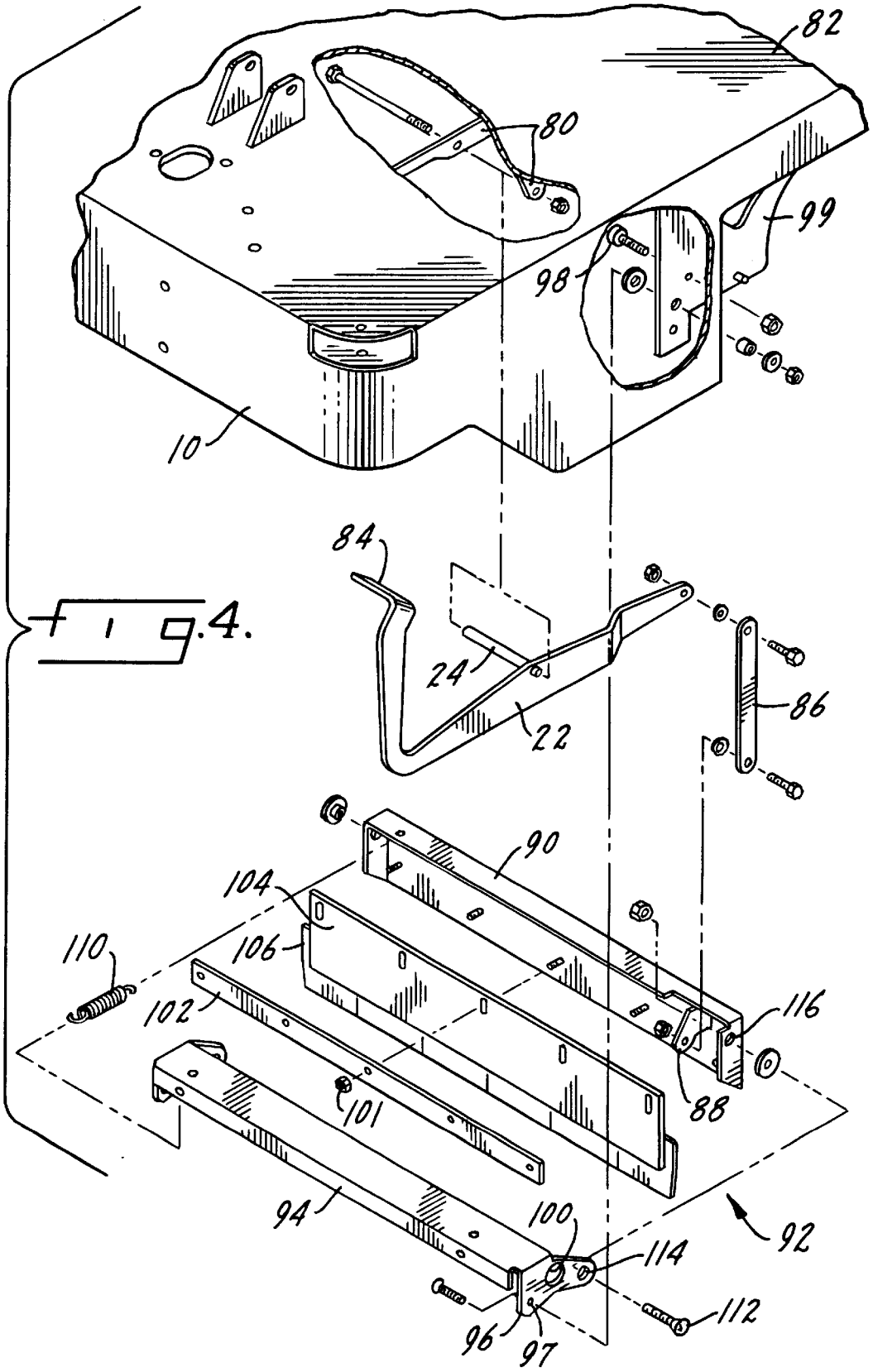
FIG. 4 is an exploded perspective illustrating the foot pedal and its connection to the front flap.

The assembly 92 includes a retainer 102 and a skirt 104 which has a downwardly extending flexible flap 106 which functions as the so-called lip of the front flap. The skirt 104 in turn will be attached to the front flap bracket 90 with fasteners 101. A spring 110 is connected at its opposite ends to the front flap bracket 90 and the front skirt bracket 94, as depicted in FIG. 4. The front flap bracket 90 is pivotally mounted to the front skirt bracket 94 by means of pins 112 which pass through an opening 114 in the skirt bracket 94 and an opening 116 in the front flap bracket 90.

Figure 5:
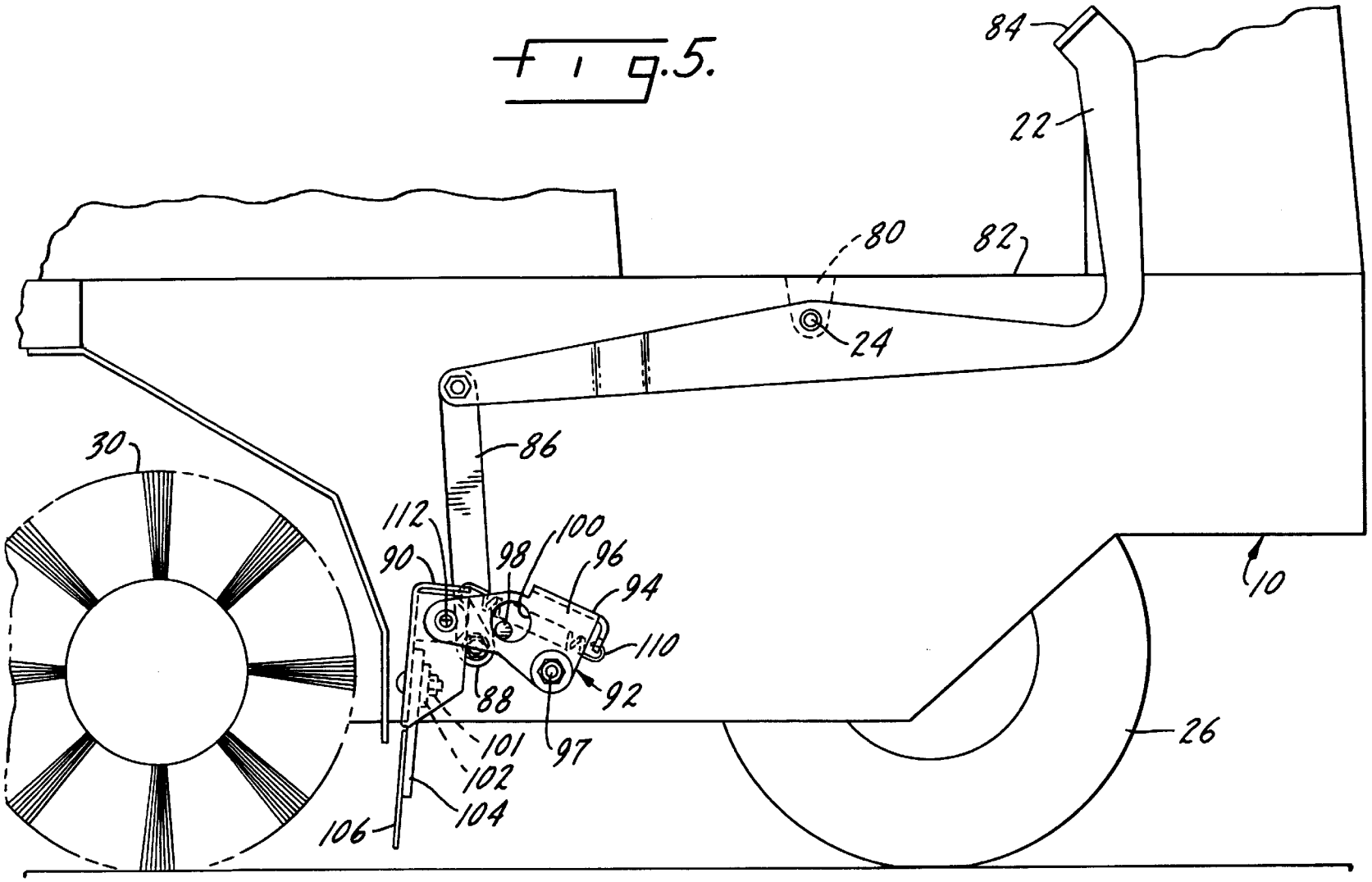
FIG. 5 is an enlarged side view illustrating the foot pedal and the front flap in a partially raised position.
Figure 6:
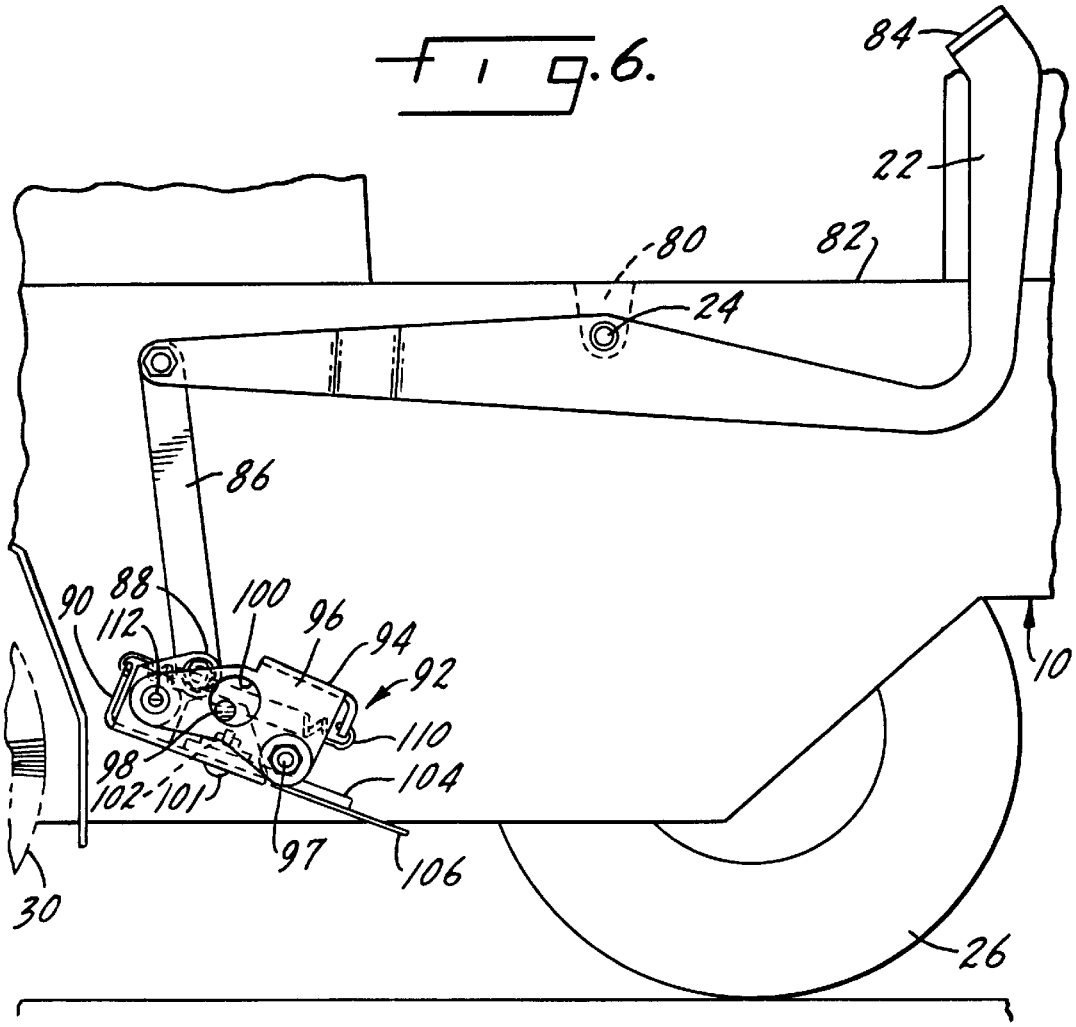
FIG. 6 is a side view, similar to FIG. 5, illustrating the foot pedal and front flap in a full raised position.

The various positions of the front flap assembly and the foot pedal are illustrated in FIGS. 2, 5 and 6. FIG. 2 illustrates the conventional and normal position of the front flap. It is located in front of the brush, with the flexible flap portion 106 being bent in a rearward direction so as in no way to impede debris from passing beneath the flap and into the zone of the brush 30. Small objects such as sand, pebbles and the like will easily pass under the flap and then be moved by the brush into the debris hopper. Larger items such as beverage cans will not pass under the front flap and may accumulate in front of it. It is to insure that this type of debris will be thrown into the debris hopper that the front flap assembly is movable.

The first movement by the operator is illustrated in FIG. 5. The pedal 84 has been depressed at its front end with the rear end rising. As the rear end rises, link 86 moves upwardly, which will pull the front flap bracket 90 and its attached skirt 104 in an upward direction, with a slight amount of counterclockwise rotation, as shown in FIG. 5. This movement will normally raise the front flap approximately 1", although that is merely illustrative. Note the different positions of the stop 98 within the opening 100 in FIG. 2 and in FIG. 5. The front flap bracket 90 and skirt 104 will pivot relative to the front skirt bracket 94, as these two portions of the flap assembly are relatively movable.

Further depression of the foot pedal 22, as illustrated in FIG. 6, will raise the link 86 to an even higher position which will rotate the front flap bracket and the attached skirt in a counterclockwise direction which both rotates the flap 106 and raises it. This will permit larger debris such as golf balls, beverage cans, etc., to pass beneath the flap and into the area adjacent the brush for movement by the brush into the debris hopper.

The above-described movement of the front flap is reversed when the operator releases the pedal. First, the front flap will return to the FIG. 5 position where it is approximately vertical and is approximately 1" off the floor. A further and final release of the foot pedal will lower it down to the FIG. 2 position and when the flap is so lowered to its normal position, the flexible portion is vertical when it strikes the floor and the forward motion of the machine naturally bends it back, as there is nothing to cause it to bend forward. Thus, the flap will be in its preferred and normal position and will again permit small debris to pass under it, but in no way will it hinder the movement of the brush in normal operation.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeping machine including a chassis, wheels for supporting the chassis, a brush mounted on the chassis for rotation in a direction to throw debris over the brush and into a debris hopper mounted on the chassis behind the brush, means mounted on the chassis for raising and lowering the brush relative to a surface to be swept, a recirculation flap positioned between the brush and the debris hopper, below a centerline of the brush, and located closely adjacent a rear portion of the brush to direct debris thrown by the brush and not reaching the debris hopper forwardly toward a brush sweeping zone, a gap between the recirculation flap and the brush rear portion, the recirculating flap having a lower flexible portion positioned adjacent the surface to be swept, means for moving the recirculation flap toward and away from the rear portion of the brush in response to movement of the brush toward and away from the surface being swept as the brush diameter is reduced to wear, whereby the gap between the rear portion of the brush and the recirculation flap remains essentially constant.

2. The sweeping machine of claim 1 wherein the means mounted on the chassis for raising and lowering the brush include a control member accessible to a driver riding on the machine.

3. The sweeping machine of claim 1 wherein the means for raising and lowering the brushes include spaced brush arms pivotally mounted on the chassis, with the brush being mounted for rotation between said spaced brush arms.

4. The sweeping machine of claim 3 wherein said recirculation flap is pivotally mounted on said chassis.

5. The sweeping machine of claim 4 including means on a pivotal brush arm for causing pivotal movement of said recirculation flap.

6. The sweeping machine of claim 5 wherein the means on a brush arm for causing pivotal movement of the recirculation flap include an arm extending outwardly from said brush arm, a lever pivotally mounted on said chassis and in contact with said outwardly extending arm, said lever being in operable contact with said recirculation flap.

7. The sweeping machine of claim 6 wherein said recirculation flap includes an extended projection, said projection being in contact with the lever pivotally mounted on said chassis, rotation of said brush arm moving said lever on said chassis, which rotates said extended projection to pivot said recirculation flap.

8. The sweeping machine of claim 1 wherein the means mounted on the chassis for raising and lowering the brush include a control lever pivotally mounted on the chassis, spaced brush arms pivotally mounted on the chassis, with the brush being mounted for rotation between said spaced brush arms, one of said spaced brush arms being pivotally connected to said control lever whereby pivotal movement of said control lever moves said sweeping brush toward and away from the surface to be swept, said recirculation flap being pivotally mounted to said chassis and having an outwardly extending projection, said recirculation flap projection being moved by pivotal movement of said one brush arm whereby movement of said sweeping brush toward and away from the surface to be swept causes concurrent movement of said recirculation flap toward and away from the brush periphery.

9. The sweeping machine of claim 1 further including side walls on opposite ends of said recirculation flap to funnel debris thrown by the brush and not reaching the debris hopper toward the brush sweeping zone.

* * * * *